US012564758B2

(12) United States Patent
Surana

(10) Patent No.: US 12,564,758 B2
(45) Date of Patent: Mar. 3, 2026

(54) SELF-AMBULATION HELPER AND ASSISTIVE REHABILITATIVE DEVICE

(71) Applicant: Prasannajeet Pramod Surana, Satara (IN)

(72) Inventor: Prasannajeet Pramod Surana, Satara (IN)

( * ) Notice: Subject to any disclaimer, the term of this patent is extended or adjusted under 35 U.S.C. 154(b) by 38 days.

(21) Appl. No.: 18/372,723

(22) Filed: Sep. 26, 2023

(65) Prior Publication Data

US 2025/0090899 A1 Mar. 20, 2025

(51) Int. Cl.
*A63B 22/00* (2006.01)
*A47D 13/08* (2006.01)

(52) U.S. Cl.
CPC ..... *A63B 22/0025* (2015.10); *A47D 13/08* (2013.01); *A63B 22/0012* (2013.01); *A63B 22/0087* (2013.01); *A63B 2022/0038* (2013.01); *A63B 2022/0041* (2013.01); *A63B 2022/0043* (2013.01); *A63B 2022/0092* (2013.01); *A63B 2022/0094* (2013.01); *A63B 2225/093* (2013.01)

(58) Field of Classification Search
CPC ..... A63B 22/0025; A63B 22/0012; A63B 22/0087; A63B 2022/0038; A63B 2022/0041; A63B 2022/0043; A63B 2022/0092; A63B 2022/0094; A63B 2225/093; A47D 13/08
See application file for complete search history.

(56) References Cited

U.S. PATENT DOCUMENTS 3,363,335 A * 1/1968 Burhns ..... A61H 1/02 601/40
3,460,272 A * 8/1969 Pellicore ..... A61H 1/02 74/615
3,582,069 A * 6/1971 Flick ..... A63B 22/203 601/33
3,589,720 A * 6/1971 Agamian ..... A63B 22/203 482/114
4,364,559 A * 12/1982 Valentine ..... A63B 22/205 482/130
4,628,909 A * 12/1986 Tietsworth ..... A61H 1/0259 601/35
4,799,475 A * 1/1989 Lams ..... A63B 21/4049 601/33
5,224,909 A * 7/1993 Hamilton ..... A63B 23/03575 601/33
5,407,406 A * 4/1995 Canela ..... A63B 23/03575 601/33

(Continued)

*Primary Examiner* — Garrett K Atkinson

(57) ABSTRACT

The present invention relates to a self-ambulation helper and assistive rehabilitative device that is primarily designed to train the initial developmental phase of early life i.e., independent crawling. The device includes a tummy rest, a pair of forearm rest, a pair of leg rests, a left supporting rod, a right supporting rod, and a main frame. The tummy rest includes a tummy bracket, a top layer, and a pair of height adjusting mechanisms. The pair of forearm rest includes a left forearm rest and a right forearm rest. The pair of leg rest includes a left leg rest and a right leg rest. Each forearm rest and each leg rest include an adjustable strap and a base support. The device ensures reinforcement of biomechanically correct training patterns through repetitive practice at home for such patients.

20 Claims, 3 Drawing Sheets

(56) References Cited

U.S. PATENT DOCUMENTS

| | | | | |
|---|---|---|---|---|
| 5,499,958 | A * | 3/1996 | Hess | A63B 21/154 482/79 |
| 7,780,585 | B1 * | 8/2010 | Rivas | A63B 22/203 482/140 |
| 7,951,050 | B2 * | 5/2011 | Raumann | A61H 15/00 482/79 |
| 8,137,250 | B1 * | 3/2012 | Caban | A63B 23/0216 482/52 |
| 8,870,726 | B2 * | 10/2014 | Watterson | A63B 22/14 482/140 |
| 9,022,909 | B2 * | 5/2015 | Kermath | A63B 21/0428 482/133 |
| 9,186,551 | B1 * | 11/2015 | Smith | A63B 22/203 |
| 9,265,986 | B1 * | 2/2016 | Godak | A63B 23/03541 |
| 9,498,674 | B2 * | 11/2016 | Zhou | A61B 5/222 |
| 9,630,056 | B2 * | 4/2017 | Rao | A63B 71/0054 |
| 11,439,868 | B2 * | 9/2022 | Stratigos | A63B 21/4033 |
| 2005/0277523 | A1 * | 12/2005 | Harbaugh | A63B 21/154 482/142 |
| 2009/0105050 | A1 * | 4/2009 | Mayo | A63B 21/0618 482/70 |
| 2010/0227748 | A1 * | 9/2010 | Campanaro | A63B 21/068 482/140 |
| 2010/0248919 | A1 * | 9/2010 | Zhou | A63B 22/203 482/139 |
| 2011/0039667 | A1 * | 2/2011 | Teng | A63B 23/0488 482/142 |

* cited by examiner

SELF-AMBULATION HELPER AND ASSISTIVE REHABILITATIVE DEVICE

TECHNICAL FIELD OF INVENTION

The present invention relates to the physiotherapy field. More particularly, the present invention relates to a self-ambulation helper and assistive rehabilitative device that is primarily designed to train the initial developmental phase of early life i.e., independent crawling.

BACKGROUND

Crawling is a four-beat gait, known as most infants' first mobility, and the process of crawling skill acquisition can be interrupted by developmental disorders. The strength and balance needed to sit up with and without support is typically developed between 6 and 8 months of age, whereas the skill to crawl is typically developed between 7 and 10 months of age.

Different crawling styles include a classic hands-and-knees or cross crawl, a bear crawl, a belly or commando crawl, a bottom scooter, a crab crawl, and a rolling crawl. It is noted that the abnormalities in crawling can be caused by infantile postural asymmetry, congenital muscular torticollis ("wry neck"), stroke, cerebral palsy, Lumbosciatica, hip dysplasia, respiratory distress syndrome (RDS), joubert syndrome, migraine, peripheral paralysis of the extremities (e.g. plexus paresis, spina bifida, paraplegia, etc.), and various myopathies.

In above mentioned conditions, it becomes a primary necessity to conceptualize such a rehabilitative device which can prove to be an easily accessible, affordable early intervention alternative on a community level. The need of the hour is to provide such a sophisticated therapeutic equipment which could provide the essentials of gait rehabilitation at their respective homes itself ultimately reducing the financial burden on the parents of such children. following are some of the known ways to solve the abovementioned problems:

For Neck control-Crunches/perturbations on Swiss ball are given as a part of conventional physiotherapy protocol. The maintenance of neck control especially during the prone on Swiss-ball phase is very difficult for the baby with CP as the muscles have to work against gravity and bear the weight of the head over it. The maintenance of prone position on unstable Swiss ball is difficult both for the physiotherapist as well as the patient himself. Besides apart from weight-bearing, there is no actual simulation of crawling activity. It is noted that there is absence of 'intermittent periodic proprioceptive stimulation' source to the neck muscles.

Vestibular stimulation—Patient is made to sit on the Swiss ball and antero-posterior as well as medio-lateral perturbations are given passively to trigger the vestibular receptors and thus ultimately train balance & equilibrium.

Sensorimotor Integration—Stroking is done on the muscle to be facilitated (or inhibited) with the help of different textures.

Passive crawling—Again it is manually performed using either one or two therapist approach. The reliability and validity of this approach is little known. The sensory feedback of hard surface for tummy time is not maintained continuously. (Which is vital in order to ensure adequate functional training). Graded Progressive Resisted Exercise (PRE) component cannot be maintained manually by the Physiotherapist. Apart from this, it is highly impossible to ensure that all of the above-mentioned components are incorporated each and every single time when the Physiotherapist is treating manually.

Further, the applicant has conducted a worldwide prior art patent search as on date to elucidate distinguishing and novel features.

U.S. Pat. No. 2,0142,91,952 A1 titled "infant crawling assist apparatus" to Lehman Kenneth includes a padded U-shaped frame and a set of wheels attached thereunder. The U-shaped frame includes a set of stabilizing rods at opposite ends to prevent a baby from falling to one side while using the device. The U-shaped frame also includes a strap assembly adapted to fasten around the baby's waist. The strap assembly comprises a fabric strap and a fastener to hold the baby in place on the padding disposed on the inner surface of the U-shaped frame.

U.S. Pat. No. 2,010,319,133A1 to Whitlock Heather L titled "baby crawling aid" includes a flat, rectangular pillow having a removable, washable cover for the pillow. The cover has a top side and a bottom side, and two opposite edges. Two flat straps are attached to the cover, each strap having an attachment means located distal from the cover. When the cover is placed on the pillow, the cover fits closely around the pillow and the straps extend outward from the pillow from the two opposite edges and may be attached together with the attachment means around the mid-section of a baby positioned on the pillow.

Although, there are a number of solutions in the form of the baby crawling aid, none of them are provided with an adjustable tummy support. In the view of above prior art, it can be understood that many solutions have been designed in an attempt to provide a similar solution, however they are complex, expensive, and inefficient.

In the light of foregoing, there is need for a self-ambulation helper and assistive rehabilitative device that overcomes problems prevalent in the prior art.

SUMMARY

It is an object of the present invention to provide a semi-automaticself-ambulation helper and assistive rehabilitative device that provides a solid multi-component framework to ensure reinforcement of biomechanically correct training patterns through repetitive practice at home for such patients.

It is another object of the present invention to provide a semi-automaticself-ambulation helper and assistive rehabilitative device that is used to train the early amateur gait, i.e., crawling in children with delayed milestones and for prevailing conditions like Cerebral Palsy (CP).

It is another object of the present invention to provide a semi-automaticself-ambulation helper and assistive rehabilitative device that is simple in construction, lightweight and economical.

It is another object of the present invention to provide a semi-automaticself-ambulation helper and assistive rehabilitative device which is portable and easy to carry.

Yet another object of the present invention is to provide a semi-automaticself-ambulation helper and assistive rehabilitative device that reduces the baby's risk of SIDS (sudden infant death syndrome).

Furthermore, object of the present invention is to provide a semi-automaticself-ambulation helper and assistive rehabilitative device that encourages the baby to develop more muscles.

According to main embodiment of the present invention, the device includes a tummy rest, a pair of forearm rest, a pair of leg, a left supporting rod, a right supporting rod, and a main frame. The tummy rest includes a tummy bracket, a top layer, and a pair of height adjusting mechanisms for each side. The pair of forearm rest includes a left forearm rest and a right forearm rest. The pair of leg rest includes a left leg rest and a right leg rest. Each forearm rest and each leg rest include an adjustable strap and a base support. The left forearm rest and the left leg rest are movably mounted on a left supporting rod. The right forearm support and the right leg rest are movably mounted on a right supporting rod. The main frame includes a pair of extension and a plurality of side walls. The extensions are fixed to the tummy bracket.

Various objects, features, aspects and advantages of the present invention will become more apparent from the following detailed description of the embodiments of the invention, along with the accompanying drawings in which like numerals represent like components.

BRIEF DESCRIPTION OF DRAWINGS

So that the manner in which the above-recited features of the present invention can be understood in detail, a more particular description of the invention, briefly summarized above, may have been referred by embodiments, some of which are illustrated in the appended drawings. It is to be noted, however, that the appended drawings illustrate only typical embodiments of this invention and are therefore not to be considered limiting of its scope, for the invention may admit to other equally effective embodiments. These and other features, benefits, and advantages of the present invention will become apparent by reference to the following text figure, with like reference numbers referring to like structures across the views, wherein.

DETAILED DESCRIPTION

Figure 1:
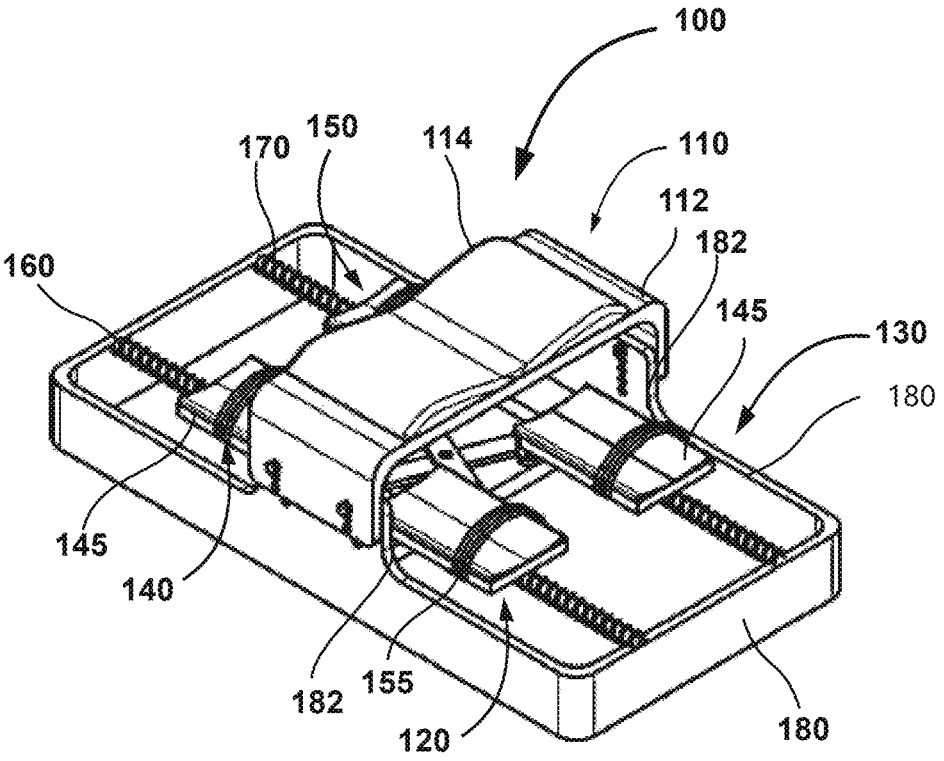
FIG. 1. shows a perspective view of a self-ambulation helper and assistive rehabilitative device in accordance with the present invention.
Figure 2:
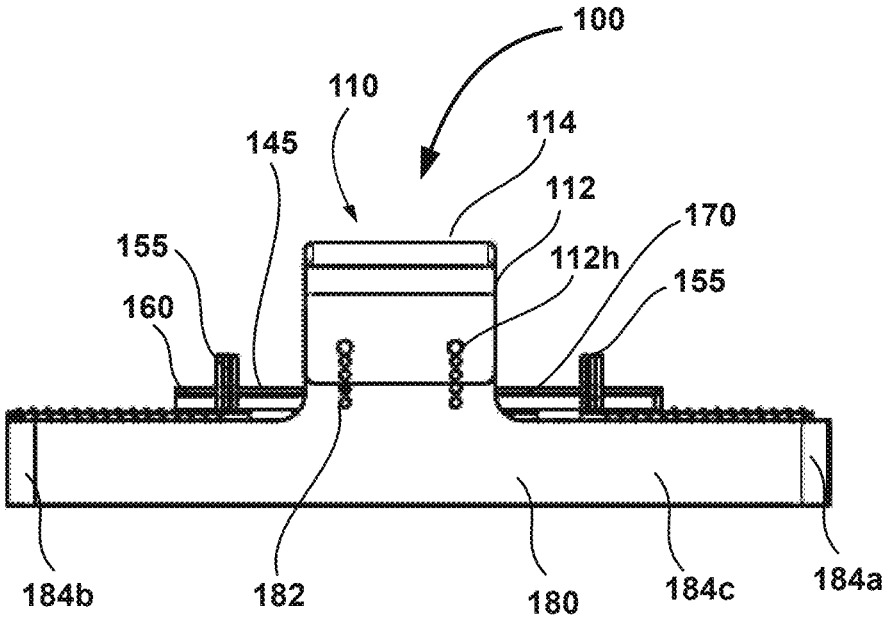
FIG. 2. shows a side view of the device of FIG. 1.

Some embodiments, illustrating its features, will now be discussed in detail. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise. Although any methods, and systems similar or equivalent to those described herein can be used in the practice or testing of embodiments, the preferred methods, and systems are now described. The disclosed embodiments are merely exemplary.

The present invention is described hereinafter by various embodiments with reference to the accompanying drawing, wherein reference numerals used in the accompanying drawing correspond to the like elements throughout the description. This invention may, however, be embodied in many different forms and should not be construed as limited to the embodiment set forth herein. Rather, the embodiment is provided so that this disclosure will be thorough and complete and will fully convey the scope of the invention to those skilled in the art. In the following detailed description, numeric values and ranges are provided for various aspects of the implementations described. These values and ranges are to be treated as examples only and are not intended to limit the scope of the claims. In addition, several materials are identified as suitable for various facets of the implementations. These materials are to be treated as exemplary and are not intended to limit the scope of the invention.

The various features and embodiments of the present invention will now be described in conjunction with the accompanying figures, namely FIGS. 1-6, which should be regarded as merely illustrative without restricting the scope and ambit of the present invention.

From herein afterward the device is to referred as a device (100).

Referring now to FIGS. 1, 2, 3, and 4 the device (100) includes a tummy rest (110), a pair of forearm rests (120, 130), a pair of leg rests (140, 150), a left supporting rod (160), a right supporting rod (170), and a main frame (180).

Figure 3:
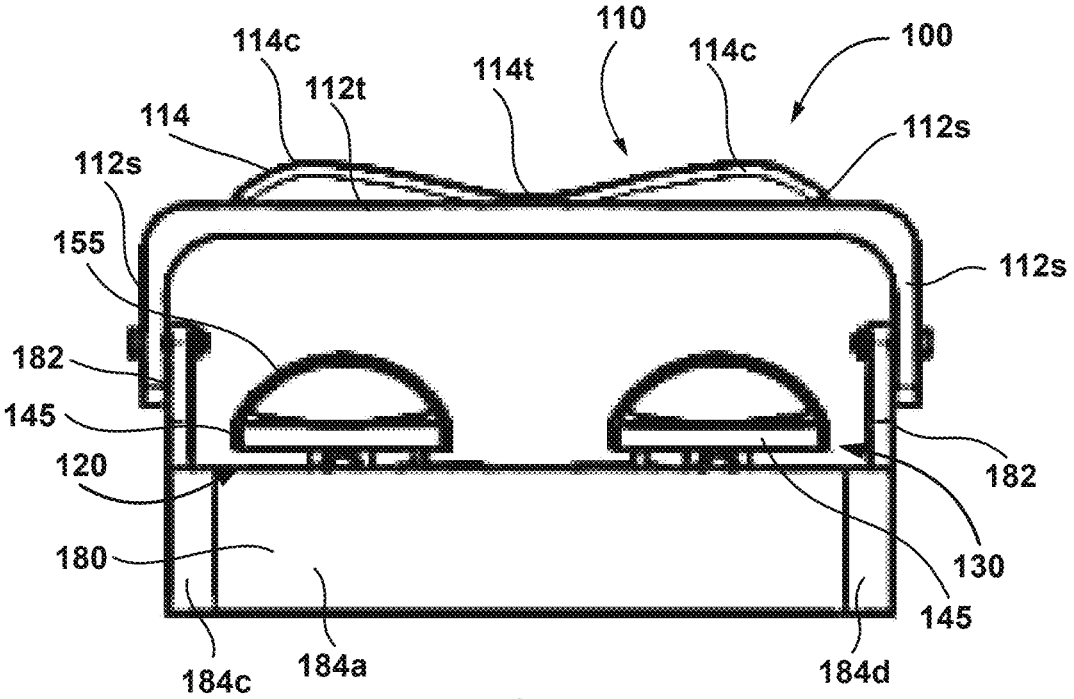
FIG. 3. shows a front view of the device of FIG. 1.
Figure 4:
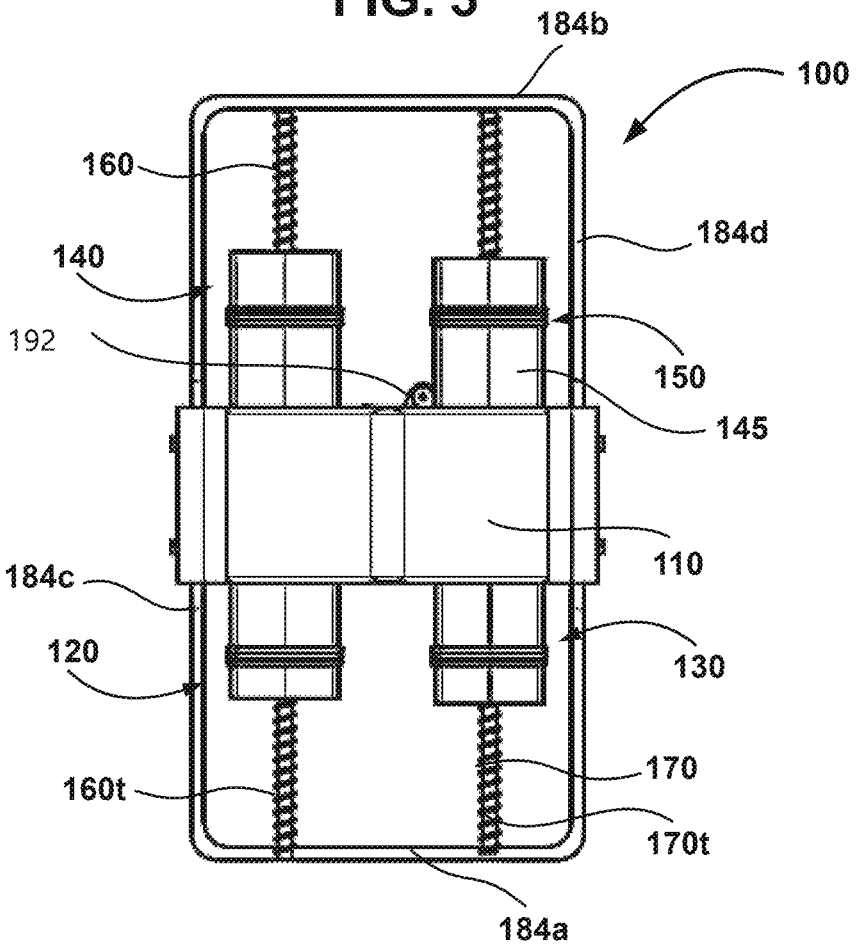
FIG. 4. shows a top view of the device of FIG. 1.

The tummy rest (110) supports the baby tummy while using the device (100). The tummy rest (110) includes a tummy bracket (112), a top layer (114), and height-adjusting mechanisms (116). The top layer (114) is made up of a soft material. The top layer (114) provides a cushioning effect. The soft materials are selected from bio-cotton, foam, and plastic foam cushioning such as polystyrene, polyurethane, polyethylene, paper fill, and/or pulp. The top layer (114) is covered with a silicone covering in order to provide comfort to the children. Referring now to FIGS. 3, the top layer (114) includes a crest (114*c*) and a trough (114*t*). The tummy bracket (112) includes a top portion (112*t*) and side portions (112*s*). The tummy bracket (112) transfers the weight of the baby to the main frame (180) and to the bottom/ground surface.

Figure 5:
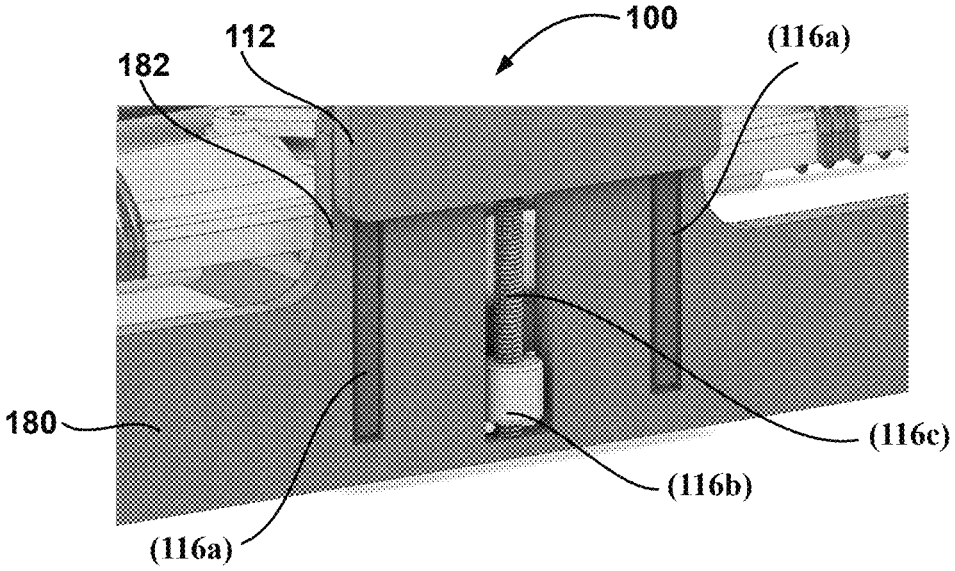
FIG. 5. shows a view of a height adjusting mechanism of the device of FIG. 1.

Referring now to FIG. 5, the height adjusting mechanism (116) includes a lever, a driving bevel gear, a lead screw (116*c*), and a driven bevel gear (116*b*). The lever is connected to a shaft of a driving bevel gear (not shown). Using the lever user can rotate the shaft of the driving bevel gear. Since driving gear is meshed with the driven bevel gear or wheel (116*b*), the lead screw (116*c*) gets powered. The lead screw (116*c*) is connected to the driven bevel gear (116*b*). The tummy rest (110) is arranged on the lead screw (116*c*). The height adjusting mechanism (116) comprises a pair of linear guides (116*a*). The pair of linear guides (116*a*) maintains the sidewise alignment of the tummy rest (110). The mechanism (116) allows user to adjust the height of the tummy rest (110) as per requirement. Therefore, the present invention can be used for babies of different body sizes and tummy shapes.

The pair of forearm rests (120, 130) includes a left forearm rest (120) and a right forearm rest (130). The pair of leg rests (140, 150) includes a left leg rest (140) and a right leg rest (150). Each rest (120, 130, 140, 150) includes an adjustable strap (155) and a base support (145). The base support (145) is made from rubber, leather, or a polymer. The adjustable strap (155) is provided for stabilizing the hands and the legs on the support (145).

Figure 6:
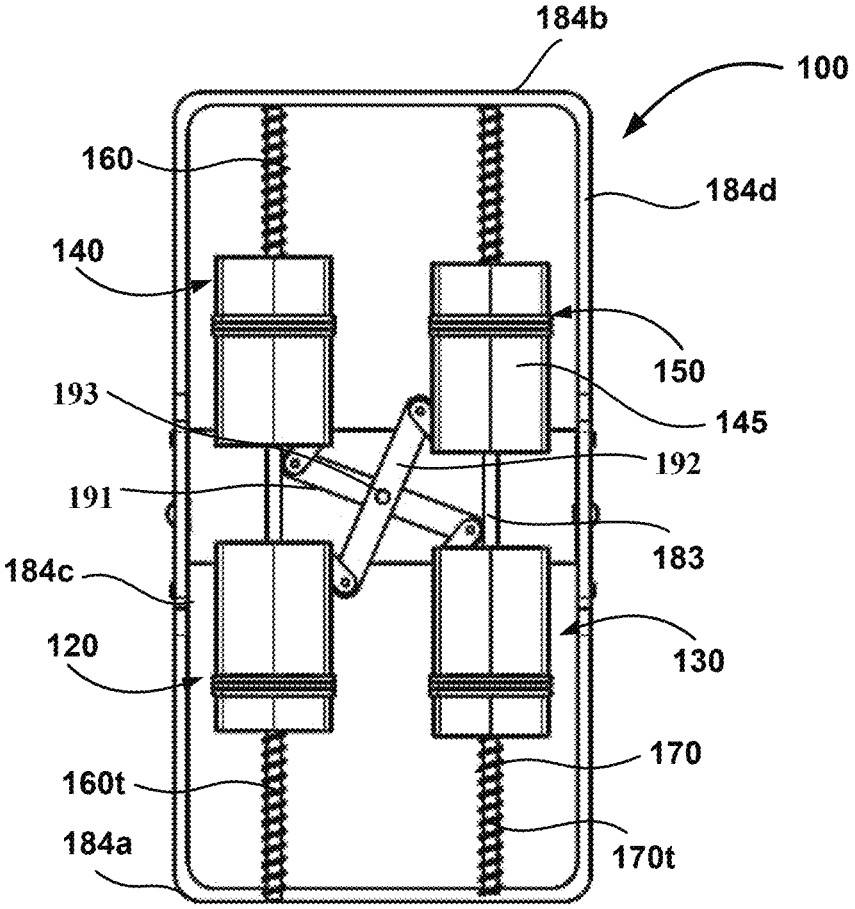
FIG. 6. shows a bottom view of FIG. 4 without reinforcing beam.

The left forearm rest (120) and the left leg rest (140) are movably mounted on the left supporting rod (160). The right forearm rest (130) and the right leg rest (150) are movably mounted on the right supporting rod (170). The right and the left supporting rods (160, 170) are fixed between a front side wall (184*a*) and a back side wall (184*b*). Each of the supporting rods (160, 170) is adapted to have threads (160*t*, 170*t*). The supporting rods (160, 170) connect the supports (145) to the main frame (180) and is provided with piston action when diagonally connected supports (145) move. Further, the left forearm rest (120) and the right leg rest (150) are fixed together by means of a first segment (191). Similarly, the right forearm rest (130) and the left leg rest (140) are fixed together by means of a second segment (192). The first segment (191) and the second segment (192) are pivoted together by means of a pivot pin (193) as best seen in FIG. 6.

The main frame (180) is made from wood, metal, or metal alloys. The mainframe (180) is covered using tough plastic, rubber, or a polymer. The main frame (180) includes a pair of extensions (182) and side walls (184*a*, 184*b*, 184*c*, 184*d*). The extensions (182) are fixed to the tummy bracket (112). The side portions (112*s*) are provided with primary side holes (112*h*). The extensions (182) are provided with secondary side holes (182*h*). The main frame (180) includes a reinforcing beam for providing extra strength thereto.

In another aspect of the present invention, the device (100) includes a motor for providing power to the height-adjusting mechanism (116).

It should be understood according to the preceding description of the present invention that the same is susceptible to changes, modifications, and adaptations, and that the said changes, modifications, and adaptations fall within the scope of the appended claims

What is claimed is:

1. A self-ambulation helper and assistive rehabilitative device (100) comprising:

a tummy rest (110) comprising a tummy bracket (112), a top layer (114), and at least one height adjusting mechanism (116);

a pair of forearm rests (120, 130) comprising a left forearm rest (120) and a right forearm rest (130) and a pair of leg rests (140, 150) comprising a left leg rest (140) and a right leg rest (150); each (120, 130, 140, 150) comprising an adjustable strap (155) and a base support (145);

wherein the left forearm rest (120) and the left leg rest (140) are movably mounted on a left supporting rod (160); and wherein the right forearm rest (130) and the right leg rest (150) are movably mounted on a right supporting rod (170); and a main frame (180) comprising a plurality of side walls (184*a*, 184*b*, 184*c*, 184*d*) and a pair of extensions (182) that are fixed to the tummy bracket (112).

2. The device (100) of claim 1, wherein the top layer (114) is made up of a soft material selected from a bio-cotton, a foam, paper fill, pulp, and/or a plastic foam cushioning comprising polystyrene, polyurethane, or polyethylene.

3. The device (100) of claim 2, wherein the top layer (114) comprises one or more crest (114*c*) and trough (114*t*).

4. The device (100) of claim 2, wherein the top layer (114) is covered with a silicone covering.

5. The device (100) of claim 1, wherein the main frame (180) is made from a wood, a metal, or metal alloys.

6. The device (100) of claim 5, wherein the mainframe (180) is covered using a tough plastic, rubber or a polymer.

7. The device (100) of claim 1, wherein the base support (145) is made from rubber, leather, or a polymer.

8. The device (100) of claim 1, wherein the height adjusting mechanism (116) comprises a lever connected to a shaft of a driving bevel gear and a lead screw (116*c*) connected to a driven bevel gear (116*b*).

9. The device (100) of claim 8, wherein the tummy rest (110) is arranged on the lead screw (116*c*).

10. The device (100) of claim 8, wherein the height adjusting mechanism (116) comprises a pair of linear guides (116*a*).

11. The device (100) of claim 1, wherein the right and the left supporting rods (160, 170) are fixed between a front side wall (184*a*) and a back side wall (184*b*) of the plurality of side walls (184*a*, 184*b*, 184*c*, 184*d*).

12. The device (100) of claim 1, wherein each of the supporting rods (160, 170) is adapted to have threads (160*t*, 170*t*).

13. The device (100) of claim 1, wherein the left forearm rest (120) and the right leg rest (150) are fixed together by means of a first segment (191).

14. The device (100) of claim 1, wherein the right forearm rest (130) and the left leg rest (140) are fixed together by means of a second segment (192).

15. The device (100) of claim 14, wherein the first segment (191) and the second segment (192) are pivoted together by means of a pivot pin (193).

16. The device (100) of claim 1, wherein the tummy bracket (112) comprises a top portion (112*t*) and side portions (112*s*).

17. The device (100) of claim 16, wherein the side portions (112*s*) are provided with a plurality of primary side holes (112*h*).

18. The device (100) of claim 1, wherein the extensions (182) are provided with a plurality of secondary side holes (182*h*).

19. The device (100) of claim 1, wherein the device (100) comprises a motor for providing power to the height adjusting mechanism (116).

20. The device (100) of claim 1, wherein the main frame (180) comprises a reinforcing beam (183).

* * * * *